United States Patent [19]

Starks

[11] 4,209,135

[45] Jun. 24, 1980

[54] SEWAGE PULVERIZER

[76] Inventor: Charles V. Starks, 1521 Texas Ct., Tavares, Fla. 32778

[21] Appl. No.: 2,124

[22] Filed: Jan. 9, 1979

Related U.S. Application Data

[63] Continuation of Ser. No. 827,491, Aug. 25, 1977, abandoned.

[51] Int. Cl.[2] ..... B02C 13/00

[52] U.S. Cl. ..... 241/46.17; 241/169.1

[58] Field of Search ..... 366/197, 200, 201, 244, 366/245, 279, 325, 330; 241/46 R, 46.17, 98, 100, 199.12, 169.1

[56] References Cited

U.S. PATENT DOCUMENTS

| | | | |
|---|---|---|---|
| 1,434,331 | 10/1922 | Ellis | 366/325 |
| 2,414,964 | 1/1947 | McPherson | 241/46.17 X |
| 3,761,026 | 9/1973 | Rohmer | 241/199.12 |
| 4,054,519 | 10/1977 | Tufts | 241/46.17 X |

*Primary Examiner*—Mark Rosenbaum

*Attorney, Agent, or Firm*—Henderson & Sturm

[57] ABSTRACT

An elongated rod structure. The rod structure is rotatable about is longitudinal axis, being detachably affixed at one end thereof to a power device for rotating the rod. An impeller structure is affixed to the end of the rod structure opposite the power device. The impeller structure includes a plurality of projections, each projection having wavy surfaces and a curved peripheral edge.

1 Claim, 7 Drawing Figures

FIG. 2
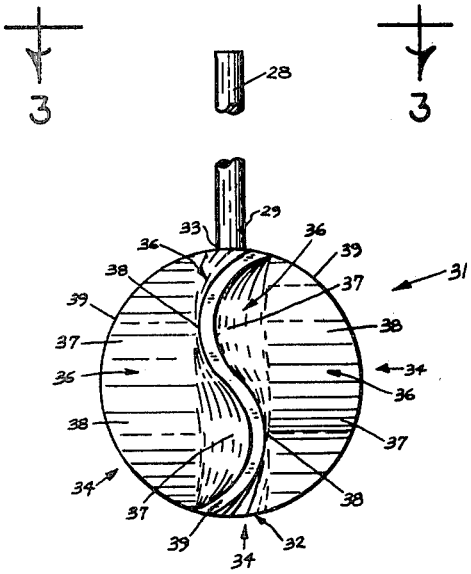
FIG. 7
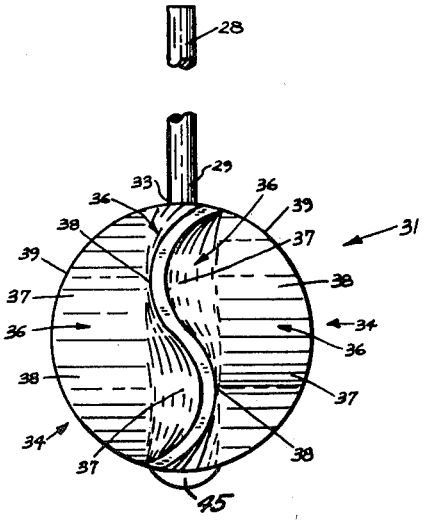
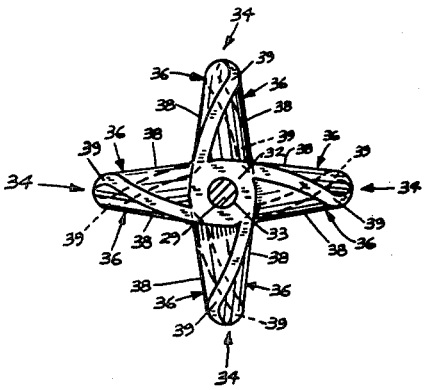
FIG. 3
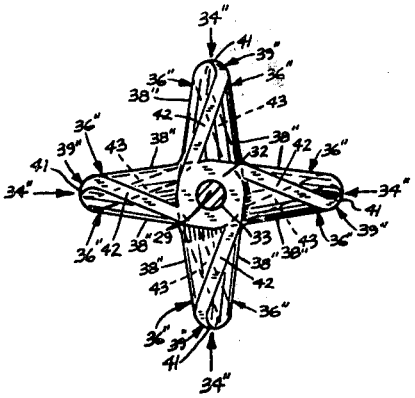
FIG. 6

SEWAGE PULVERIZER

CROSS REFERENCE

This application is a continuation of application Ser. No. 827,491, filed Aug. 25, 1977, now abandoned.

BACKGROUND OF THE INVENTION

This invention relates to recreational vehicles and boats, accessories therefor, and tools or equipment employed in the maintenance thereof. More specifically, this invention relates to toilets and holding tank structures employed in recreational vehicles and boats and to apparatus employed to prevent the clogging thereof.

Many boats and over-the-road recreational vehicles have marine or recreational toilets which empty into concealed holding tanks. Human waste is retained in the holding tank, the tank being emptied periodically at dump stations, generally every three to five days depending upon family size. When a recreational vehicle is in transit, movement of the vehicle generally causes breaking-up of the solid waste and substantially reduces any tendency of the solid waste to build-up within the tank, although some accumulation may occur should the holding tank become substantially full such that movement of liquids within the tank is hampered. When a destination has been reached, the recreational vehicle is parked and connected to a sewer in a trailer park or the like, the tendency of the solid waste to build up becomes particularly pronounced. There is no vehicular movement to cause disintegration of the solid waste, there being little fluid movement within the tank except during drainage of the tank. Solid waste therefore has a tendency to build up within, and to eventually clog the holding tank, particularly directly beneath, or adjacent to, where the toilet is coupled to, and empties into, the holding tank. Where the drainage valve is somewhat worn or the dump valve is left open such that fluids can seep therethrough, the liquid waste tends to separate from the solid waste, resulting in even more accelerated build-up of solid wastes.

Currently, special liquids and powders are employed to break up solid waste such that it will drain out of the holding tank. Special bathroom tissue, comprised of material which disintegrates rapidly, is available and increases flowability of solid wastes. However, these special liquids, powders and tissue are expensive, the tissue, for example, generally being three to four times as expensive as ordinary bathroom tissue. Solid waste can still accumulate and clog the holding tank, and the liquids and powders do not provide a rapid means for dissolving the clogging waste. Some marine or recreational vehicle toilets or waste disposal systems have built-in macerators or rotating blades for disintegrating solid waste; however, such toilets are generally complex, expensive and space-consuming. Also, some hose structures have been developed which, when used, are inserted through the toilet and into the holding tank. When water is run therethrough, the hose structure flops around within the tank, thereby loosening the solid waste. Such hose structures, however, are messy and inconvenient to use.

SUMMARY OF THE INVENTION

A sewage pulverizer includes an elongated rod structure. A power device, such as a power hand drill, is detachably affixed to one end of the rod and, when actuated, rotates the rod about its longitudinal axis. An impeller structure is attached to the end of the rod structure opposite the power device. The longitudinal axes of the rod and impeller are aligned, and the impeller rotates with the rod. The impeller includes, extending away from the longitudinal axis thereof, a plurality of projections. Each projection has wavy or undulating surfaces and an extended, peripheral edge having an arcuate configuration when viewed from the side. When the sewage pulverizer is operated, the impeller is extended through the recreational toilet, into the holding tank and against the clogging, accumulated solid waste. Rotation of the impeller then disintegrates the solid waste.

It is an object of this invention to provide a sewage pulverizer which cleanly, rapidly and effectively operates to disintegrate accumulations of solid waste thereby to prevent the clogging of boat and recreational vehicle waste disposal systems.

Another object of this invention is to provide a sewage pulverizer which operates to disintegrate solid waste while minimizing the possibility of damaging the holding tank of a recreational vehicle or boat.

It is also an object of this invention to provide a sewage pulverizer which renders unnecessary, or minimizes the need for, the use of expensive chemicals and special tissue papers with recreational vehicle and boat toilets.

A further object of this invention is to provide an attachment for powered hand drills whereby such drills may be conveniently employed to achieve the aforementioned objects.

These objects and other features and advantages of the sewage pulverizer of this invention will become readily apparent upon referring to the following description, when taken in conjunction with the appended drawing.

BRIEF DESCRIPTION OF THE DRAWING

The sewage pulverizer of this invention is illustrated in the drawing wherein:

FIG. 2 is an enlarged, foreshortened side elevational view of the sewage pulverizer attachment;

FIG. 3 is an enlarged, top plan view of the sewage pulverizer attachment taken along line 3—3 of FIG. 2;

FIG. 6 is an enlarged, horizontal sectional view of the embodiment of FIG. 5 taken along line 6—6 of FIG. 5; and FIG. 7 is a view like FIG. 2 but showing a further modified form of impeller.

DESCRIPTION OF THE PREFERRED EMBODIMENT

Figure 1:
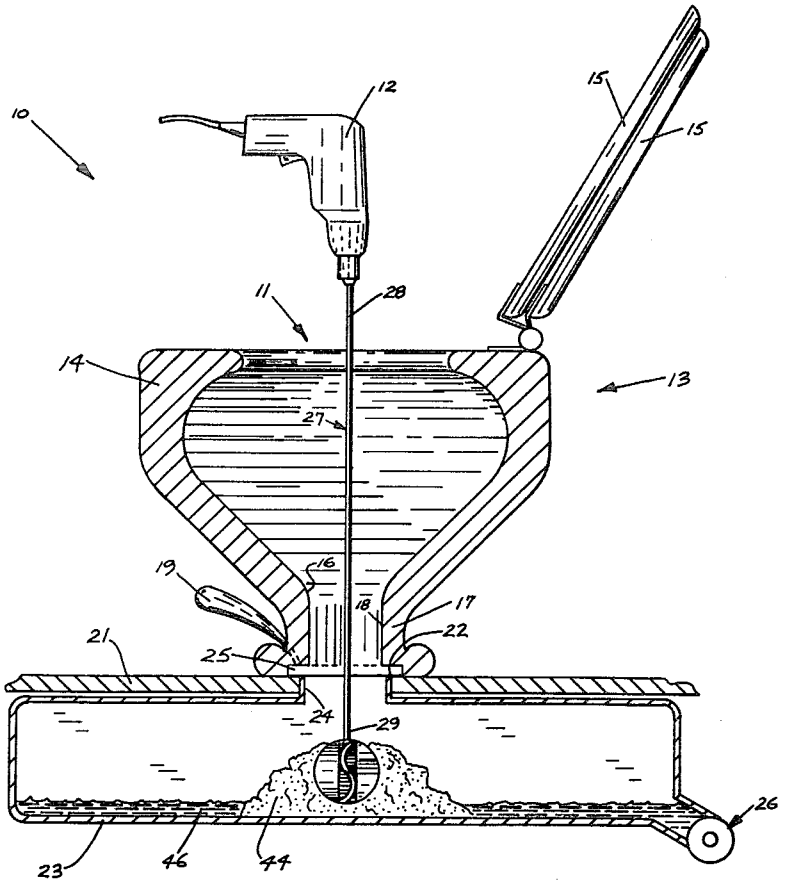
FIG. 1 is a side elevational view of the sewage pulverizer showing the employment thereof with a toilet and holding tank, shown partly in section, of a recreational vehicle or boat.

The sewage pulverizer of this invention is illustrated generally at 10 in FIG. 1 and includes a pulverizer attachment 11 coupled to a powered hand drill 12. The sewage pulverizer 10 is generally employed with respect to a standard recreational vehicle or marine toilet 13, typically constructed of a high impact polyethlene. The toilet 13 includes an open bowl portion 14 having hinged closure members 15 affixed at the upper end thereof and having a central opening 16 formed at the lower end thereof. The portion 14 is contiguous with a base portion 17, the opening 16 communicating with a passageway 18 formed through the base 17. The pedal 19 for actuating the water rinsing or flushing structure (not shown) is pivotally mounted to the base 17. The vehicle floor or boat deck 21 has an aperture 22 formed therethrough. The base 17 is mounted to the floor 21 such that the passageway 18 and aperture 22 are axially aligned.

A holding tank 23 is disposed below the floor or deck 21 and is generally elongated, having rectangular longitudinal and transverse sections. The holding tank 23 is generally horizontally disposed and has an upwardly projecting breech portion 24, which portion 24 extends into the aperture 22 and is axially aligned with the passageway 18 and aperture 22. A sealing member 25 is disposed about the juncture of the passageway 18, aperture 22 and breech portion 24. The holding tank 23 is disposed against the underside of the floor or deck 21. The tank 23 has a valved drainage structure 26.

Referring now to FIG. 2, the pulverizer attachment 11 includes an elongated rod portion 27 having first and second ends 28, 29. The first end 28 is detachably received by the powered hand drill 12. The pulverizer attachment also includes impeller means 31 coaxial with and attached fixedly to the lower end 29 of the rod 27 so that the two rotate in unison.

The impeller means includes an elongated (here upright) central section 32 having a top and a bottom and in which an axial bore 33 is formed to receive the lower end of the rod 27. The drill drives the impeller means in a clockwise direction as seen from above. In the embodiment shown here, the impeller means has four identical imperforate projections 34 integral with the central section 32 and extending radially outwardly therefrom at equally angularly spaced intervals. Each projection or wing 34 extends outwardly from the top of the central section 32 and curves outwardly and extends downwardly and thence curves inwardly back to the bottom of the central section to provide rounded tops or corners on the projections or wings as seen in side elevation. (FIGS. 2, 4 and 6) Each projection or wing, as seen in end elevation, has the shape of a vertically elongated letter S to provide a wavy or undulating surface 36 made up of a trailing concave area 37 and a leading convex area 38, these being established respectively by the upper and lower halves of the S. The concavity and convexity are relative to the direction of rotation of the impeller means. Each projection has its maximum thickness or cross-sectional dimension adjacent to its junction with the central section 32 and is slightly tapered radially outwardly to a peripheral edge 39.

As best seen in FIG. 3, and considering the clockwise rotation of the impeller means, the junction of each projection with the top of the central section 32 is angularly offset in trailing relation to the junction of the projection with the bottom of the central section. This configuration provides that the widest portion of each projection area exerts mainly circumferential forces on the waste, with these forces diminishing or being converted to vertical forces as the convexity narrows. In other words, the upper half of each wing or projection moves waste circumferentially as well as upwardly and downwardly while the lower half, being concave acts like a cup to act on and cut the lower part of the waste, which being "older" is expected to be harder than the upper or "new" waste.

The trailing relationships of the junctions of the tops and bottoms of the central section 32, as noted, afford pocketed areas facing in the direction of rotation at the tops (FIG. 3) and facing counter-clockwise at the bottoms. The combination of the upper pocketed areas and the wing or projection curvatures exploit both radial and circumferential forces to thoroughly break up the waste, the pocketed areas being successively filled and emptied during rotation. The lower pocketed areas afford low-pressure areas behind the wings or projections, further disintegrating the waste and preventing adherence of the waste to the impeller means.

Figure 4:
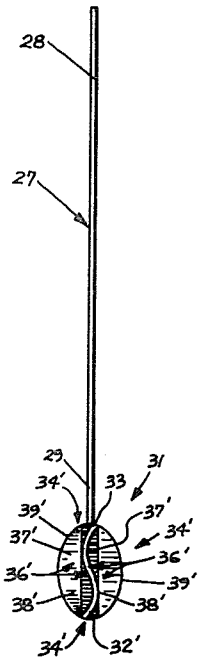
FIG. 4 is a side elevational view of an alternate embodiment of the sewage pulverizer attachment.

An alternate embodiment of the pulverizer attachment 11 is illustrated in FIG. 4. Modified projections 34' extend from a central portion which may be somewhat lengthened, as shown at 32'. The wavy surfaces 36', including the concave and convex areas 37', 38' thereof, are narrower in that the ratio of the dimension of maximum extension, from the central portion 32 or 32', of the projections 34' to the longitudinal dimension of the central portion 32 or 32' is less. The peripheral edge 39' are S-shaped in end view but have a flatter arcuate configuration in side view.

Figure 5:
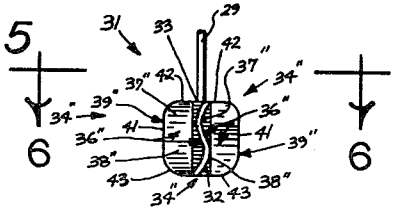
FIG. 5 is a fragmentary side elevational view of a further alternate embodiment of the sewage pulverizer attachment.

A further alternate embodiment of the pulverizer attachment 11 is illustrated in FIGS. 5 and 6. Modified projections 34" have wavy surfaces 36", including concave and convex areas 37", 38" thereof, which are somewhat more rectangular in configuration. The peripheral edges 39' are S-shaped in end view. When viewed from the side, the edges 39' each have a longitudinal straight section 41, transverse straight sections 42 and curved sections 43 connecting the straight sections 41, 42.

In a further modified form shown in FIG. 7, the impeller means may take any of the forms previously described but, for purposes of simplicity, the modification is shown as being based on the impeller means of FIG. 2 and the same reference numerals have been employed. The modification comprises a projection or button-like portion 45 projecting downwardly from and integral with the bottom of the central section 32. This button serves to space the wings or projections 34 slightly above the bottom of the holding tank and adds further to the manual control of the entire device so that the user may maneuver the impeller means through wider areas without direct contact between the projections 34 and portions of the tank.

The rod portion 27 may be fabricated from a metal, however, it is preferable that there be a surface coating of teflon or rubber or the like. The impeller portion 31 is preferably fabricated from a nylon or a plastic or the like. The impeller 31 also could be formed from bearing materials such as comprise solid or thrust bearings. The impeller 31 and rod 27 could both be formed, independently or cast as one piece, from such bearing materials.

When the sewage pulverizer 10 is to be employed, the pulverizer attachment 11 is connected to the power hand drill 12. The attachment 11 is inserted through the open bowl portion 14, opening 16, passageway 18 and breech 24 such that the impeller portion 31 is disposed within the holding tank 23 against the accumulated solid waste 44. Actuation of the drill 12 causes rotation of the rod 27 and therefore of the impeller 31. The rotation of the impeller 31 causes the projections 34, 34' or 34" to disintegrate the waste 44 by directly cutting the waste 44 and by causing any liquid waste 46 present to act against the solid waste 44. All waste is rendered substantially flowable such that the holding tank 23 drains freely and remains unclogged.

The pulverizer attachment 11 is a convenient attachment for the power drill which is often a standard tool in the homeowner's toolbox, yet the sewage pulverizer 10 could be purchased as a unit at the convenience of the individual. Use of the pulverizer 10 eliminates or greatly reduces any need for the purchase of expensive special bathroom tissues or special chemicals and is faster and more effective for the disintegration of solid waste.

The pulverizer attachment 11 is sturdy, the increasing of the cross-sectional dimension of the projections 34, 34' or 34" toward the central portion 32 or 32' facilitating this. Furthermore the configuration of the impeller 31 minimizes the possibility of damaging the holding tank 23. The semi-circular and arcuate side view configurations of the peripheral edges 39, 39', the curved sections 43 of the edges 39" and the wavy surfaces 36, 36', 36" facilitate this result. The impeller 31 also efficiently effects the disintegration of solid waste both by directly cutting the waste and by causing action of any liquid waste against the solid waste. Again, the peripheral edges 39, 39', 39" and wavy surfaces 36, 36', 36" facilitate this result. The composition of the impeller 31 also aids in minimizing the chances of damaging the holding tank 23.

Although a preferred embodiment and modifications thereof have been disclosed herein, it is to be remembered that various modifications and alternate constructions can be made thereto without departing from the full scope of the invention, as defined in the appended claims.

I claim:

1. An attachment for a power hand drill for application to accumulations of solid waste in the holding tank of a recreational vehicle, comprising elongated rod means having upper and lower ends and capable of being detachably connected at its upper end to a drill for rotation about its lengthwise axis in a clockwise direction as seen from above; and impeller means coaxial with the rod means at the lower end of said rod means for disintegration of solid waste, said impeller having an upright central portion including a top and a bottom, said top coaxially receiving the lower end of the rod means, said impeller further having four identical imperforate projections integral with the central portion and extending radially outward therefrom at equally angularly spaced intervals, each projection extending from the top of the central portion forming a junction with the central portion and curving outwardly and extending downwardly and thence curving inwardly back to the bottom of the central portion to provide rounded tops and bottoms on the projections as viewed in side elevation, but each projection as viewed in end elevation having the shape of a vertically elongated letter S, the upper half of the S being smoothly convex in the aforesaid direction of rotation and the lower half of the S being smoothly concave in said direction, the junction of each projection with the top of the central portion being angularly offset in trailing relation to its junction with the bottom of the central portion, and a downwardly projecting portion coaxially integral with the bottom of the central portion and extending below the level of the junctions of the projections with the bottom of the central portion, said last-named portion having an undersurface formed generally as a hemisphere coaxial to said central portion.

* * * * *